US006450354B2

(12) United States Patent
Chien

(10) Patent No.: US 6,450,354 B2
(45) Date of Patent: Sep. 17, 2002

(54) STRUCTURE OF A TOOL BOX

(76) Inventor: James Chien, P.O. Box 82-144, Taipei (TW)

( * ) Notice: Subject to any disclaimer, the term of this patent is extended or adjusted under 35 U.S.C. 154(b) by 0 days.

(21) Appl. No.: 09/846,614

(22) Filed: May 2, 2001

(30) Foreign Application Priority Data

May 2, 2000 (TW) ..... 089207222

(51) Int. Cl.[7] ..... B65D 6/00
(52) U.S. Cl. ..... 220/4.01; 220/4.22; 206/373
(58) Field of Search ..... 220/4.01, 4.22, 220/4.03; 206/373, 372, 370, 379

(56) References Cited

U.S. PATENT DOCUMENTS 4,234,080 A * 11/1980 Gellert ..... 220/4.01
4,951,812 A * 8/1990 Chen ..... 206/373
5,271,501 A * 12/1993 Chen ..... 206/373
6,068,123 A * 5/2000 Chen ..... 200/373
6,073,789 A * 6/2000 Lundblade ..... 220/4.22
6,283,292 B1 * 9/2001 Chen ..... 206/373

* cited by examiner

*Primary Examiner*—Joseph M. Moy
(74) *Attorney, Agent, or Firm*—Leong C. Lei

(57) ABSTRACT

A tool box includes two upper covers each having an upper flange provided an upper clasp and a lower flange provided with a lower clasp which are configured to engage firmly with an upper and lower recesses of the base so as to keep the upper covers firmly engaged with the base, the upper cover being formed with a first groove at the upper flange and a second groove at the lower flange, the upper covers being provided with two parallel tracks a base formed with an upper flange and a lower flange respectively having two first grooves and two second grooves, the base being formed with two parallel tracks, two connecting members for joining together the upper covers with the base, the two connecting members having two parallel tracks, and two detachable containers having an upper raised edge and a lower raised edge configured and dimensioned to be sidably engaged with the grooves of the upper covers and the grooves of the base, whereby the two detachable containers can slide on a top of the base thereby increasing the capacity for receiving tools and causing much convenience in use.

2 Claims, 5 Drawing Sheets

STRUCTURE OF A TOOL BOX

BACKGROUND OF THE INVENTION

1. Field of the Invention

This invention is related to an improvement in the structure of a tool box and in particular to one having two detachable containers which can slide on the top of the base thereby increasing the capacity for receiving tools and causing much convenience in use.

2. Description of the Prior Art

Various kinds of toolboxes are being sold on the market, and these have almost become necessities in our daily life in order to enable us to maintain, repair or assemble various kinds of articles. There are many kinds of commonly used tools such as wrenches, screwdrivers, spanners and so on. However, the conventional toolbox uses clasps to engage the cover with the body portion, and such a toolbox has a number of tool receiving recesses formed integrally with the upper and lower covers by injection molding. The space of the tool receiving recesses is limited and shaped to fit certain types of tools and so they cannot be used to receive any tools of different shapes. Hence, the interior of the tool box will become disorganized and to prevent this, the user may buy tools which fit the tool box, but which do not necessarily meet the user's tool requirements.

In general, tools are used with many small components such as screws, nails, nuts and so on, but the conventional tool box does not have space especially designed for receiving such small components, so that the user must buy an additional box to receive the small components, thereby causing inconvenience in use, and causing the user to carry an additional box.

Therefore, it is an object of the present invention to provide an improvement in the structure of a tool box which can obviate and mitigate the above-mentioned drawbacks.

SUMMARY OF THE INVENTION

This invention is related to an improvement in the structure of a tool box.

It is the primary object of the present invention to provide a tool box having two detachable containers which can slide on the top of the base thereby increasing the capacity for receiving tools and causing much convenience in use.

It is another object of the present invention to provide a tool box which includes two upper covers each having an upper flange provided an upper clasp and a lower flange provided with a lower clasp which are configured to engage firmly with an upper and lower recesses of the base so as to keep the upper covers firmly engaged with the base, the upper cover being formed with a first groove at the upper flange and a second groove at the lower flange, the upper covers being provided with two parallel tracks a base formed with an upper flange and a lower flange respectively having two first grooves and two second grooves, the base being formed with two parallel tracks, two connecting members for joining together the upper covers with the base, the two connecting members having two parallel tracks, and two detachable containers having an upper raised edge and a lower raised edge configured and dimensioned to be sidably engaged with the grooves of the upper covers and the grooves of the base.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
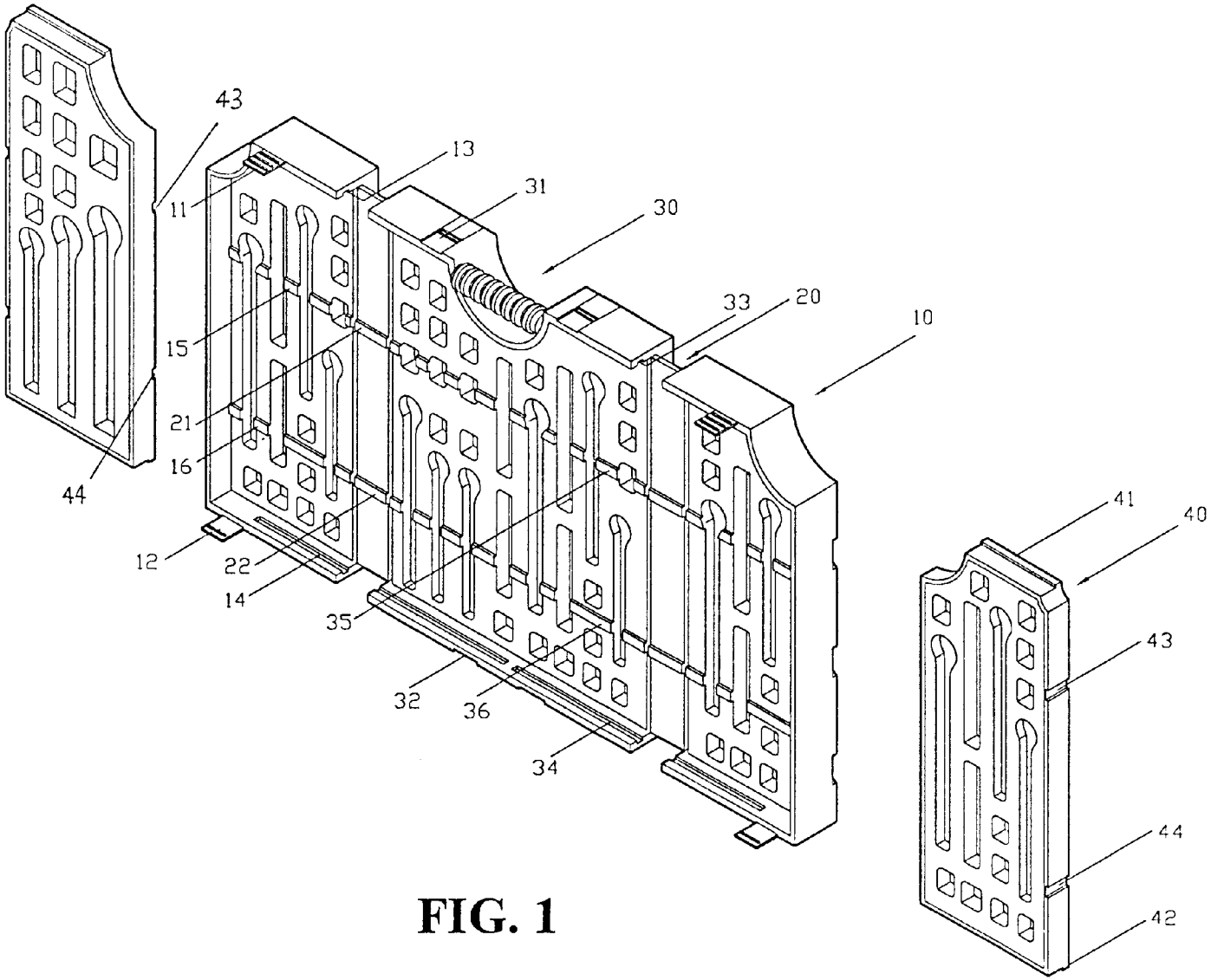
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

With reference to the drawings and in particular to FIG. 1 thereof, the tool box according to the present invention generally comprises two upper covers 10, a base 30, two connecting members 20 and two detachable containers 40. The base 30 is formed with an upper flange 31 and a lower flange 32. The upper cover 10 has an upper flange provided an upper clasp 11 and a lower flange provided with a lower clasp 12 which are configured to engage firmly with an upper and lower recesses 31 and 32 of the base 30 so as to keep the upper covers 10 firmly engaged with the base 30. The connecting members 20 are used for joining together the upper covers 10 with the base 30. The upper cover 10 is formed with a first groove 13 at the upper flange and a second groove 14 at the lower flange. The base 30 has two first grooves 33 at the inner side of the upper flange and two second grooves at the inner side of the lower flange. The upper covers 10 are provided with two parallel tracks 15 and 16, the two connecting members 20 has two parallel tracks 21 and 22 which are aligned with the tracks 15 and 16 respectively, and the base 30 is formed with two parallel tracks 35 and 36 which are aligned with the tracks 21 and 22 respectively. The detachable container 40 has an upper raised edge 41 and a lower raised edge 42 configured and dimensioned to be slidably engaged with the grooves 13 and 14 of the upper covers 10 and the grooves 33 and 34 of the base 30. Further, the detachable container 40 is formed with slots 43 and 44 at the bottom configured to be engageable with the tracks 15 and 16 of the upper covers 10 and the tracks 35 and 36 of the base 30.

Figure 2:
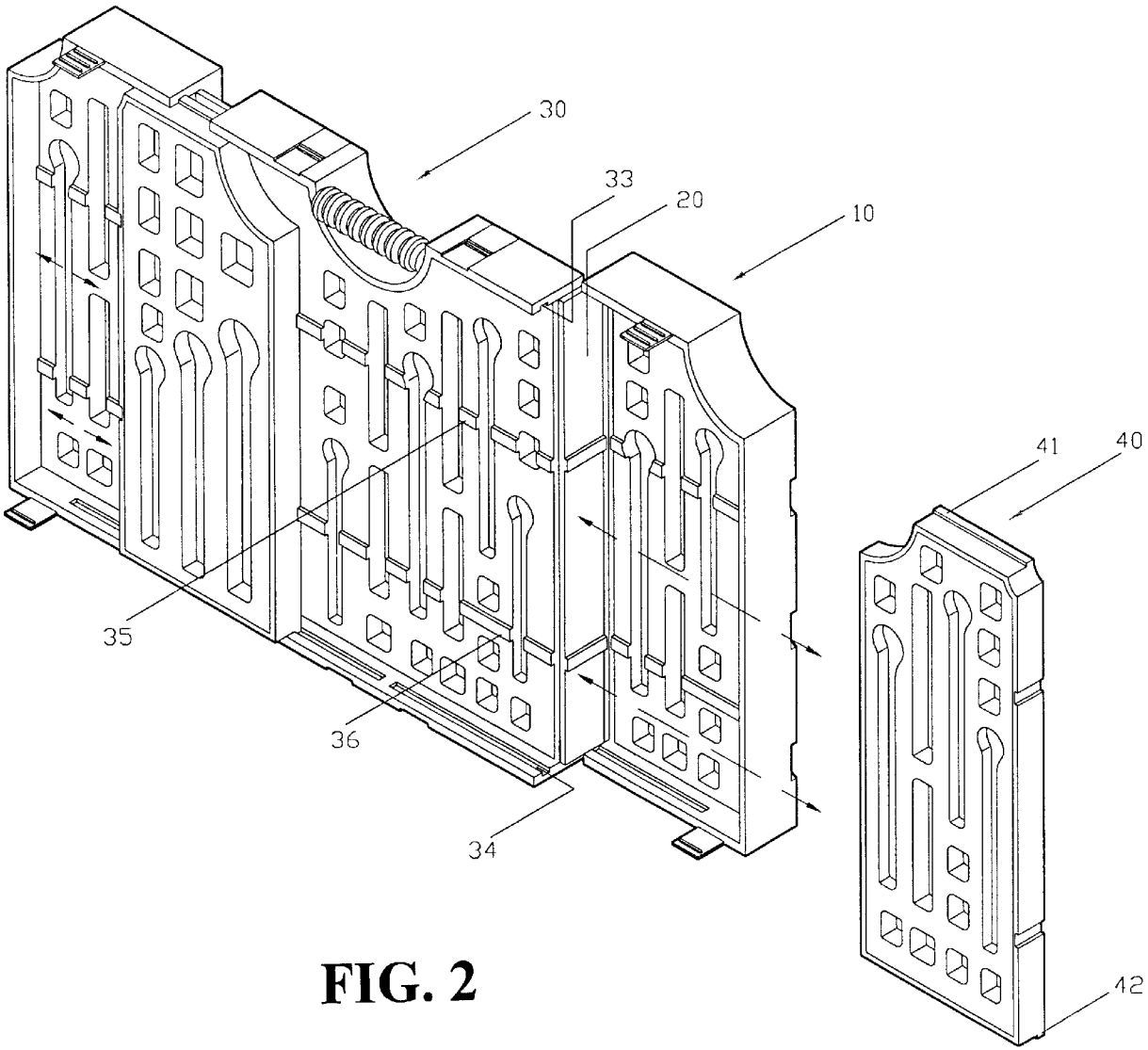
FIG. 2 illustrates how the detachable container slides on the base.
Figure 5:
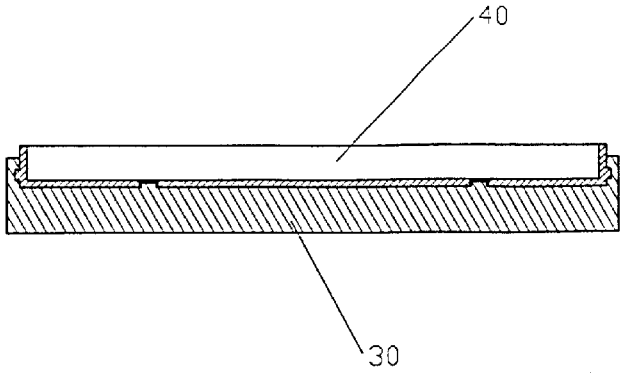
FIG. 5 is a sectional view showing the engagement between the detachable container and the base.
Figure 6:
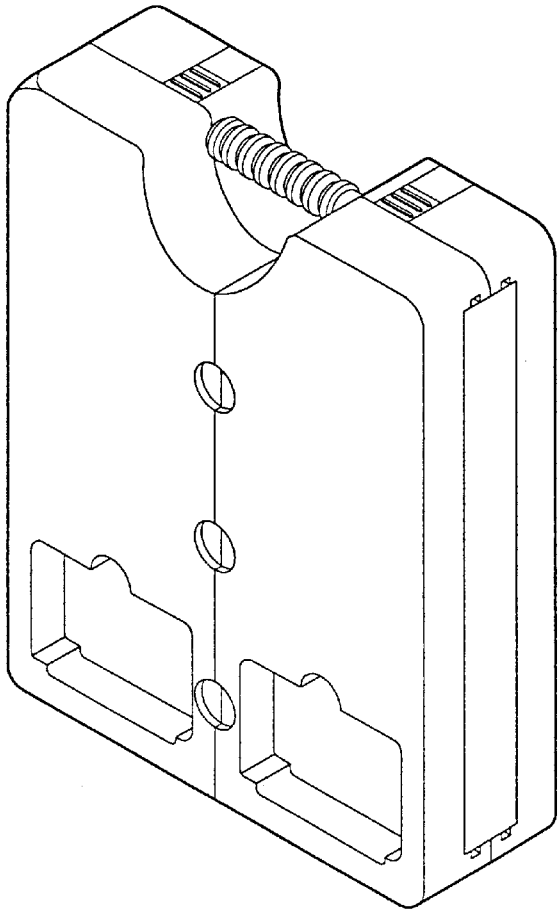
FIG. 6 is a perspective view of the present invention.

Referring to FIGS. 2 and 5, when desired to engage the detachable container 40 with the base 30 or to disengage the detachable container 40 from the base 30, it is only necessary to turn the upper covers 10 downwardly so as to make the upper covers 10 dispose at an angular position with respect to the base 30 thereby enabling the upper and lower raised edges 41 and 42 of the detachable container 40 to engage or disengage with the grooves 33 and 34 of the base 30.

Figure 3B:
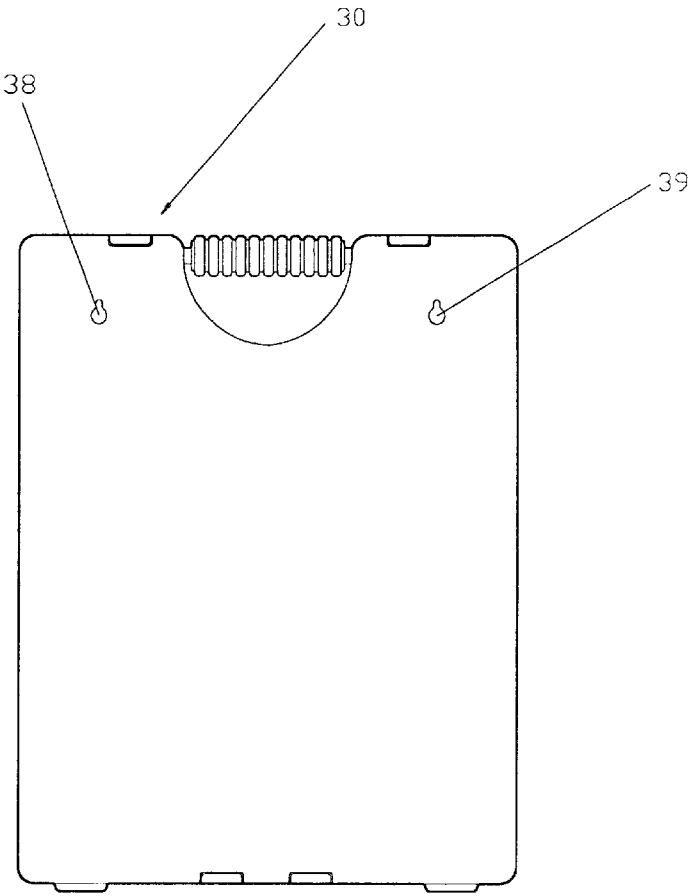
FIG. 3B is a rear view of the present invention.
Figure 3A:
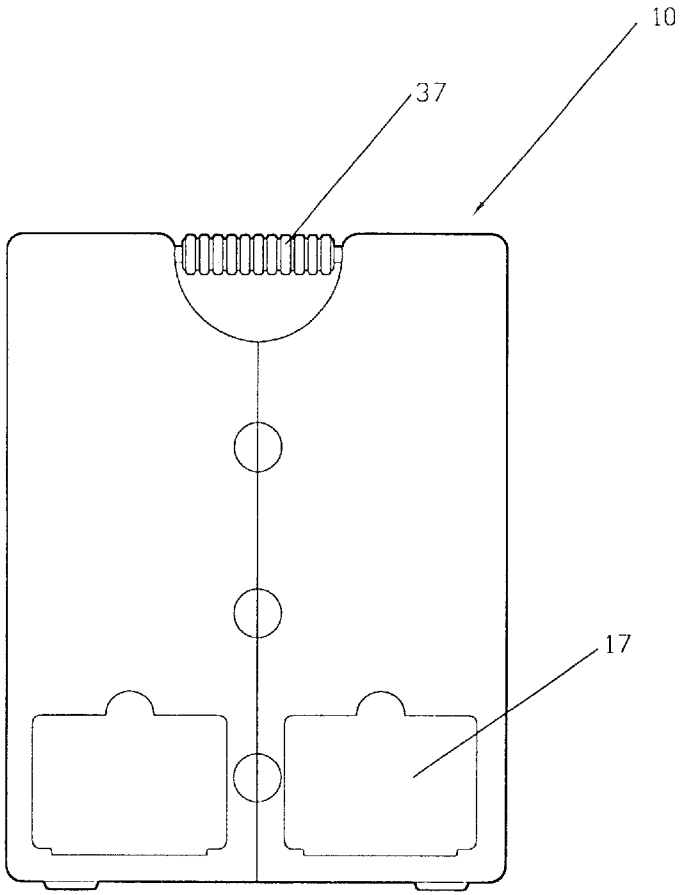
FIG. 3A is a front view of the present invention.

As shown in FIG. 3A, the outer side of each of the outer covers 10 is formed with a chamber 17 for receiving small components such as screws, nut, nails, and so on. The chamber 17 is provided with a cover for keeping the small components therein. The base 30 is provided with a slip-proof handle 37 at the intermediate portion of the top and two holes 38 and 39 (see FIG. 3B) at the back for hanging on a wall.

Figure 4:
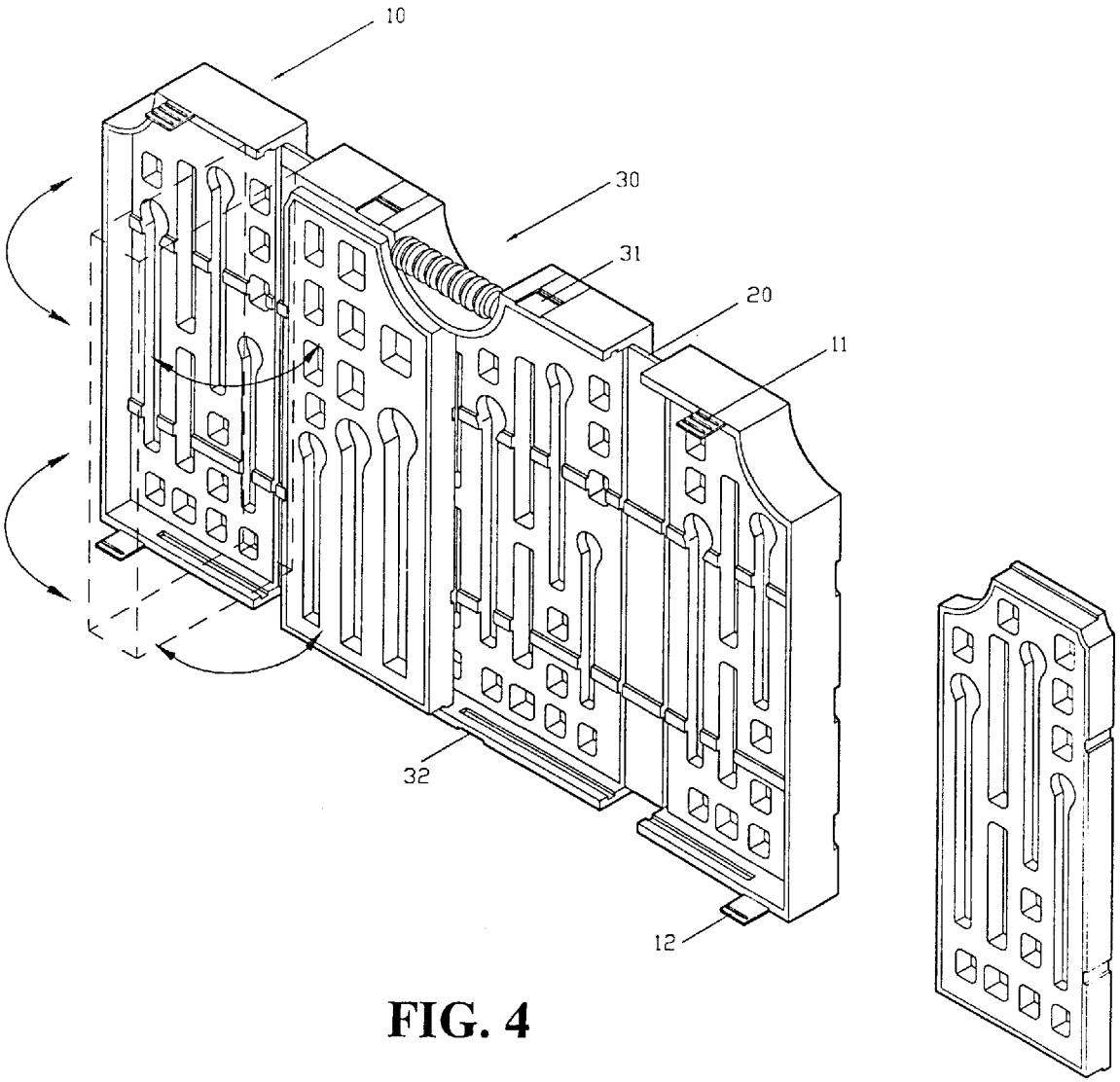
FIG. 4 illustrates how to turn open or close the upper cover.

As shown in FIG. 4, by means of the connecting members 20, the upper covers 10 can be opened with respect to the base 30 as desired, and by means of the engagement between the clasps 11 and 12 and the recesses 31 and 32, the upper covers 10 can be kept closed thereby enabling the tool box to be carried and hung conveniently.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A tool box comprising:

two upper covers each having an upper flange provided an upper clasp and a lower flange provided with a lower clasp which are configured to engage firmly with an upper and lower recesses of said base so as to keep said upper covers firmly engaged with said base, said upper cover being formed with a first groove at said upper flange and a second groove at said lower flange, said upper covers being provided with two parallel tracks a base formed with an upper flange and a lower flange respectively having two first grooves and two second grooves, said base being formed with two parallel tracks;

two connecting members for joining together said upper covers with the base, said two connecting members having two parallel tracks; and two detachable containers having an upper raised edge and a lower raised edge configured and dimensioned to be slidably engaged with said grooves of said upper covers and said grooves of said base;

whereby said two detachable containers can slide on a top of said base thereby increasing the capacity for receiving tools and causing much convenience in use.

2. The tool box as claimed in claim 1, wherein said upper covers and said base have upper and lower flanges formed with grooves slidably engaged with upper and lower raised edges of said detachable containers.

* * * * *